US005207431A

United States Patent [19]

Joseph

[11] Patent Number: 5,207,431

[45] Date of Patent: May 4, 1993

[54] INSURANCE POLICY GAME APPARATUS

[76] Inventor: Neamor L. Joseph, 2323 N. Eastwood St., Santa Anna, Calif. 92701

[21] Appl. No.: 852,402

[22] Filed: Mar. 16, 1992

[51] Int. Cl.[5] ..... A63F 3/00

[52] U.S. Cl. ..... 273/278; 273/290

[58] Field of Search ..... 273/256, 278, 257, 279, 273/288, 289, 290

[56] References Cited

U.S. PATENT DOCUMENTS

| | | | |
|---|---|---|---|
| 1,013,161 | 1/1912 | Hewitt | 273/278 |
| 1,760,287 | 5/1930 | Schippers | 273/278 |
| 2,088,137 | 7/1937 | McAbee | 273/278 |
| 2,526,300 | 10/1950 | Todd | 273/278 |
| 3,980,307 | 9/1976 | Raub | 273/278 |
| 4,557,486 | 12/1985 | Stuckmayer | 273/278 |

FOREIGN PATENT DOCUMENTS

| | | | |
|---|---|---|---|
| 2394315 | 2/1979 | France | 273/278 |

*Primary Examiner*—V. Millin
*Assistant Examiner*—William E. Stoll
*Attorney, Agent, or Firm*—Leon Gilden

[57] ABSTRACT

A game apparatus includes a game board arranged with a plurality of columns of insurance categories, with each category including a plurality of spaces corresponding to first through fifth faces of a second die member, with the second die member including a sixth lettering to indicate loss of turn. A first die member indicates type of category. Each player is afforded a predetermined number of markers with modified marker structure indicating addition or loss of premium relative to the spaces of each category. A player accumulating a least total relative to the insurance categories is declared the winner of the game procedure.

1 Claim, 4 Drawing Sheets

INSURANCE POLICY GAME APPARATUS

BACKGROUND OF THE INVENTION

1. Field of the Invention

The field of invention relates to game apparatus, and more particularly pertains to a new and improved insurance policy game apparatus wherein the same is arranged to direct a least total to attain winning status in the game.

2. Description of the Prior Art

Games of various types are utilized throughout the prior art competing various players relative to one another. Such games are exemplified in U.S. Pat. Nos. 4,842,281; 4,936,589; 4,799,686; and 4,871,177. Such games are directed to various categories to include banking, stock purchases, and the like.

As such, it may be appreciated that there continues to be a need for a new and improved insurance policy game apparatus as set forth by the instant invention which addresses both the problems of ease of use as well as effectiveness in construction in directing players to achieve a least total in accumulating insurance policies and in this respect, the present invention substantially fulfills this need.

SUMMARY OF THE INVENTION

In view of the foregoing disadvantages inherent in the known types of game apparatus now present in the prior art, the present invention provides an insurance policy game apparatus wherein the same utilizes various categories of insurance and various premiums associated therewith to direct players to accumulate various totals in play of the game. As such, the general purpose of the present invention, which will be described subsequently in greater detail, is to provide a new and improved insurance policy game apparatus which has all the advantages of the prior art game apparatus and none of the disadvantages.

To attain this, the present invention provides a game apparatus including a game board arranged with a plurality of columns of insurance categories, with each category including a plurality of spaces corresponding to first through fifth spaces of a second die member, with the second die member including a sixth lettering to indicate loss of turn. A first die member indicates type of category. Each player is afforded a predetermined number of markers with modified marker structure indicating addition or loss of markers with modified marker structure indicating addition or loss of premium relative to the spaces of each category. A player accumulating a least total relative to the insurance categories is declared the winner of the game procedure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved insurance policy game apparatus which has all the advantages of the prior art game apparatus and none of the disadvantages.

It is another object of the present invention to provide a new and improved insurance policy game apparatus which may be easily and efficiently manufactured and marketed.

It is a further object of the present invention to provide a new and improved insurance policy game apparatus which is of a durable and reliable construction.

An even further object of the present invention is to provide a new and improved insurance policy game apparatus which is susceptible of a low cost of manufacture with regard to both materials and labor, and which accordingly is then susceptible of low prices of sale to the consuming public, thereby making such insurance policy game apparatus economically available to the buying public.

Still yet another object of the present invention is to provide a new and improved insurance policy game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
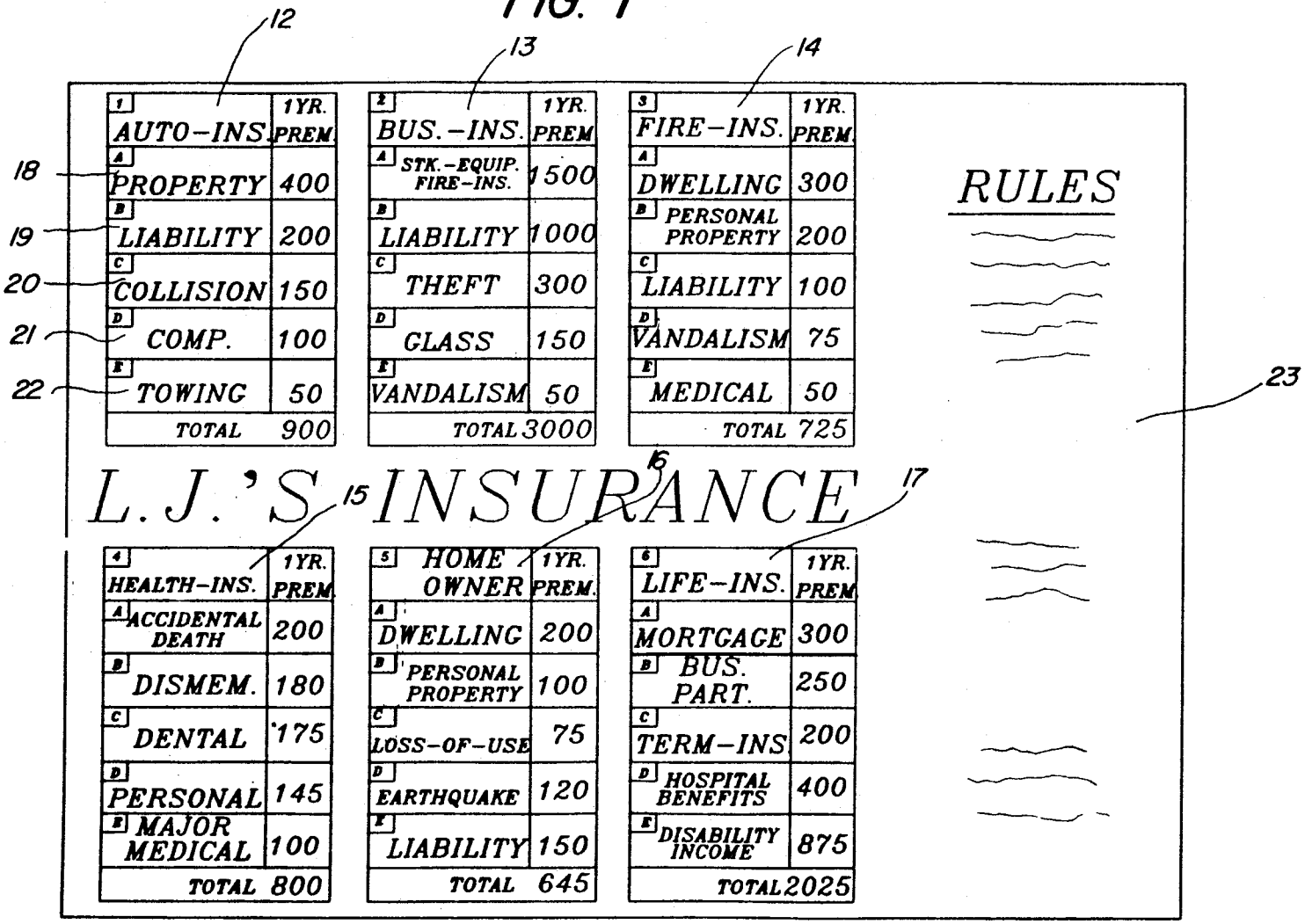
FIG. 1 is an orthographic top view of the game board of the invention.

With reference now to the drawings, and in particular to FIGS. 1 to 8 thereof, a new and improved insurance policy game apparatus embodying the principles and concepts of the present invention and generally designated by the reference numerals 11 through 39 will be described.

More specifically, the insurance policy game apparatus of the invention essentially comprises a game board 11, as illustrated in FIG. 1. The game board includes a plurality of column insurance categories defined by first, second, third, fourth, fifth, and sixth insurance category columns 12–17 respectively. Column 12–17 includes a respective first, second, third, and fourth insurance premium spaces 18–22 directed to a contrasting cost of varying totals. A rule space 23 is arranged to have the game rules imparted thereon for ease of access in play of the game.

Figure 2:
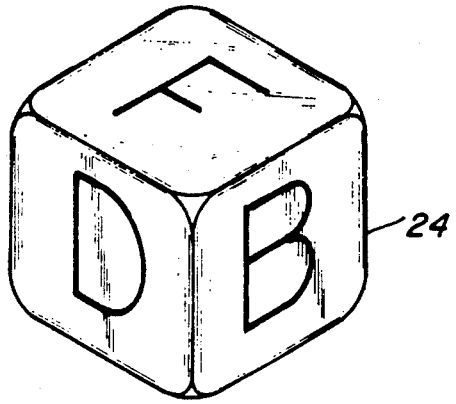
FIG. 2 is an isometric illustration of the first die member utilized by the invention.
Figure 3:
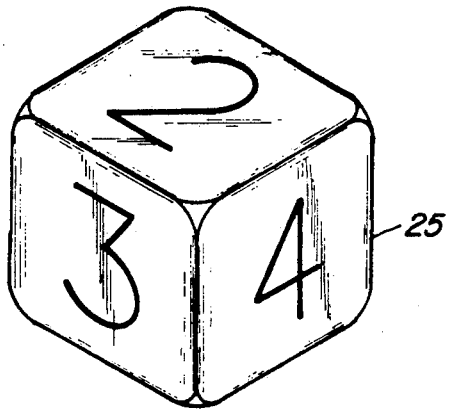
FIG. 3 is an isometric illustration of the second die member utilized by the invention.
Figure 4:
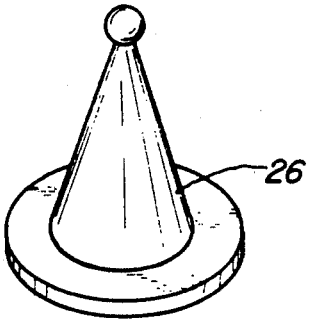
FIG. 4 is an isometric illustration of a typical token utilized by the invention.
Figure 5:
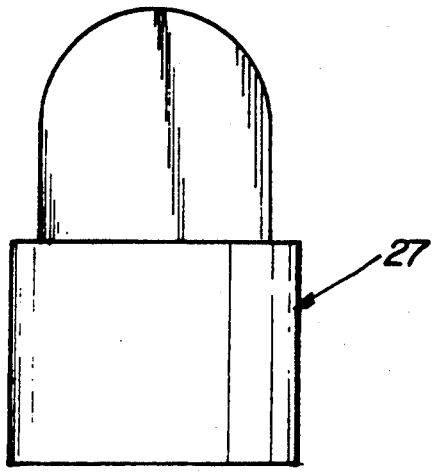
FIG. 5 is an orthographic view, taken in elevation, of a modified token structure.
Figure 7:
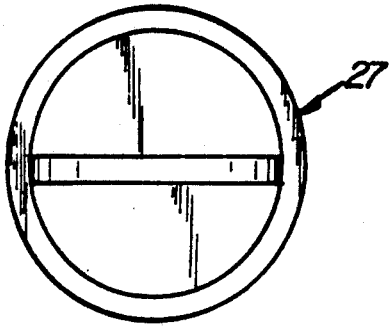
FIG. 7 is an orthographic top view of the token structure as set forth in FIG. 5.
Figure 6:
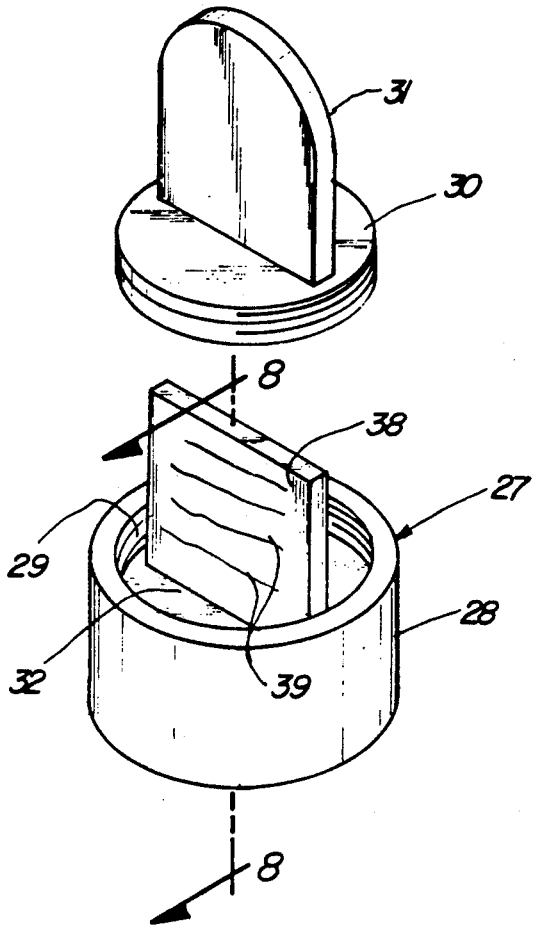
FIG. 6 is an isometric illustration of the modified token structure.
Figure 8:
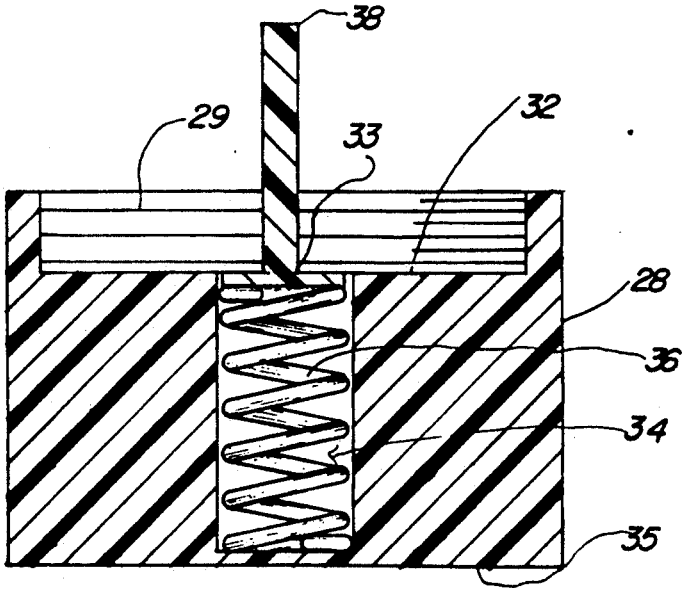
FIG. 8 is an orthographic view, taken along the lines 8—8 of FIG. 6 in the direction indicated by the arrows.

The FIGS. 2 and 3 respectively indicate the use of respective first and second six sided die members 24 and 25. The first die member 24 includes the lettering "A" through "F" inclusively, with the second die member 25 including the integers 1–6 inclusively. Each player is afforded a predetermined number of indicator markers 26.

In play of the game, players are afforded a plurality of turns each in sequence, wherein the numerals 1–6 of the second die member indicates the category column 12–17, wherein the lettering "A" through "E" indicates the first through fifth insurance premium space 18–22 of an associated and designated category column. For example, should an individual be directed to roll the digit four of the second die member 25 and the lettering "A" of the first die member, the fourth category column 15 is thereby selected, with the first insurance premium space 18 indicating a premium of $200. Should a player roll the letter "F" of the sixth space of the first die member, that player immediately loses a turn, wherein a subsequent player takes a turn. In this manner, the first player to position all of the tokens on respective spaces 18–22 and attaining a lowest total cost in this procedure is declared a winner.

FIGS. 5–8 indicate the use of a modified indicator marker 27, including a cylindrical base housing 28 (see FIGS. 6 and 8), with the base housing 28 including an internally threaded cavity 29. The internally threaded cavity 29 threadedly receives a cylindrical externally threaded lid 30, including a lid flange 31 extending upwardly thereof for ease of manual grasping of the lid relative to the housing 28. The housing cavity 29 includes a housing cavity floor 32, with a slot 33 diametrically directed through the floor 32, with the slot 33 positioned in communication with the housing second cavity 34 that is coaxially aligned within the cylindrical base housing 28 and extends from the base housing floor 35 to the slot 33. A spring member 36 is captured within the housing second cavity 34, with a directional flange 38 extending upwardly and orthogonally relative to the housing cavity floor 32, including a flange base plate integrally and orthogonally mounted to a lower distal end of the directional flange 38 positioned within the housing second cavity 34 to an upper distal end of the spring 36. Further directions 39 are imparted onto the directional flange 38 to direct players to add or deduct dollar totals relative to the insurance premium spaces 18–22 upon landing upon such space as directed by the first and second die members. In this manner, a further element of chance is directed to the players in play of the game.

It is noted that a predetermined number of such indicator members 26 such as 12 as an arbitrary number are forwarded each player, wherein the numbers 26 and modified indicator members 27 may be utilized in combination relative to one another in play of the game.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An insurance policy game apparatus, comprising, a game board, the game board including a predetermined number of category columns, the columns arranged in a parallel relationship relative to each other, wherein each category column of said category columns includes a further predetermined number of premium spaces, wherein each premium space indicates a contrasting numerical total relative to the other premium spaces of that column, and the game board includes a rule space arranged for accommodating game rules thereon, and a first multi-sided die member, wherein the die member includes a number of first die member sides equal to the predetermined number, and a second multi-sided die member, wherein the second multi-sided die member includes a number of second die member sides equal to the predetermined number, and a plurality of indicator markers, wherein each player receives a plurality of the plurality of indicator markers, and at least one of the indicator markers afforded each player includes a cylindrical base housing, the cylindrical base housing includes an internally threaded cavity directed from an upper distal end of the cylindrical base housing, wherein the internally threaded cavity includes a cavity floor, and a lid arranged for securement to the internally threaded cavity, wherein the lid includes a lid flange extending upwardly relative to the lid, and the cavity floor includes a floor slot diametrically directed through the cavity floor, and the housing second cavity that is coaxially aligned within the cylindrical base housing extending from the slot downwardly into the base housing, and a spring mounted within the second cavity, and a directional flange projecting from the slot, wherein the directional flange includes a flange base plate positioned within the second cavity mounted to an upper distal end of the spring, and the directional flange includes further directions imparted thereon to selectively add or deduct a total from an indicated value of the respective insurance premium spaces.

* * * * *